US010757502B2

(12) United States Patent
Lai et al.

(10) Patent No.: US 10,757,502 B2
(45) Date of Patent: Aug. 25, 2020

(54) SPEAKER

(71) Applicant: MERRY ELECTRONICS (SHENZHEN) CO., LTD., Guangdong (CN)

(72) Inventors: Tsai-Ti Lai, Taichung (TW); Chun-Pin Chen, Taichung (TW)

(73) Assignee: MERRY ELECTRONICS(SHENZHEN) CO., LTD., Guangdong (CN)

( * ) Notice: Subject to any disclaimer, the term of this patent is extended or adjusted under 35 U.S.C. 154(b) by 0 days.

(21) Appl. No.: 16/166,181

(22) Filed: Oct. 22, 2018

(65) Prior Publication Data

US 2019/0394561 A1 Dec. 26, 2019

(30) Foreign Application Priority Data

Jun. 21, 2018 (TW) ..... 107121361 A
Aug. 22, 2018 (TW) ..... 107129347 A

(51) Int. Cl.

| | |
|---|---|
| ***H04R 1/28*** | (2006.01) |
| ***H04R 7/04*** | (2006.01) |
| ***H04R 9/02*** | (2006.01) |
| ***H04R 9/06*** | (2006.01) |

(52) U.S. Cl.

CPC ..... *H04R 1/2811* (2013.01); *H04R 7/04* (2013.01); *H04R 9/025* (2013.01); *H04R 9/06* (2013.01); *H04R 2400/11* (2013.01)

(58) Field of Classification Search

CPC ..... H04R 1/2811; H04R 9/025; H04R 7/04; H04R 9/06; H04R 2400/11

See application file for complete search history.

(56) References Cited

U.S. PATENT DOCUMENTS

| | | | | |
|---|---|---|---|---|
| 6,487,297 | B1 * | 11/2002 | Chin-Fa | H04R 1/345 381/345 |
| 8,515,116 | B2 * | 8/2013 | Lee | H04R 1/1041 381/338 |
| 8,831,266 | B1 * | 9/2014 | Huang | H04R 1/1091 381/380 |
| 8,837,765 | B2 * | 9/2014 | Lin | H04R 1/2807 381/371 |
| 8,878,735 | B2 * | 11/2014 | Kvist | H01Q 13/10 343/718 |
| 10,165,344 | B2 * | 12/2018 | Imai | H04R 1/323 |
| 10,244,302 | B2 * | 3/2019 | Zhao | H04R 1/1041 |
| 2013/0077800 | A1 * | 3/2013 | Pan | H04S 3/004 381/74 |
| 2013/0136290 | A1 * | 5/2013 | Huang | H04R 1/2811 381/345 |
| 2013/0259287 | A1 * | 10/2013 | Tseng | H04R 1/1016 381/380 |

(Continued)

*Primary Examiner* — Oyesola C Ojo

(74) *Attorney, Agent, or Firm* — CKC & Partners Co., LLC

(57) ABSTRACT

A speaker includes a frame, a partition wall and a pitch-adjustment ring. The partition wall is coupled with the frame to isolate a high-pitched sound zone from a low-pitched sound zone. A pitch-adjustment ring is rotatably coupled to the frame and has at least one permeable section and at least one non-permeable section. The pitch-adjustment ring is rotatable to align the at least one permeable section with the high-pitched sound zone or the low-pitched sound zone.

12 Claims, 9 Drawing Sheets

(56) References Cited

U.S. PATENT DOCUMENTS

| | | | | |
|---|---|---|---|---|
| 2015/0237436 | A1* | 8/2015 | Wang | H04R 1/1091 381/380 |
| 2017/0094386 | A1* | 3/2017 | Trainer | G10K 11/17857 |
| 2017/0238088 | A1* | 8/2017 | Wen | H04R 1/1058 381/373 |
| 2017/0245044 | A1* | 8/2017 | Cartwright | H04R 1/2811 |
| 2018/0221207 | A1* | 8/2018 | Cobabe | A61F 11/00 |

* cited by examiner

SPEAKER

CROSS-REFERENCE TO RELATED APPLICATION

This application claims priority to Taiwan Application Serial Number 107121361, filed Jun. 21, 2018 and Taiwan Application Serial Number 107129347, filed Aug. 22, 2018, both of which are herein incorporated by reference.

BACKGROUND

Field of Invention

The present disclosure relates to a speaker, and more particularly, to a speaker equipped with a pitch-adjustable functionality.

Description of Related Art

Listening to music has become an indispensable part of modern life to regulate tension and monotony. Therefore, the sound quality of music produced by the speakers (such as speakers, headphones, etc.) of general consumer products and the experience of using the speaker to listening to music will affect consumption. As consumer demands for sound quality are also higher and higher, the requirements for speakers of general consumer products are increasingly taken care so as to improve the sound quality and the consumer experience.

Generally speaking, a speaker with a small volume, such as an earphone, is capable of accommodating single one sound-producing unit, which is difficult to simultaneously consider the sound experience of high-pitched and low-pitched sound. How to improve the output quality of high-pitched and low-pitched sound in smaller speakers is one of the focusing researches developed by speaker manufacturers.

SUMMARY

In one or more embodiments, a speaker includes a frame, a partition wall and a pitch-adjustment ring. The partition wall is coupled with the frame to isolate a high-pitched sound zone from a low-pitched sound zone. A pitch-adjustment ring is rotatably coupled to the frame and has at least one permeable section and at least one non-permeable section. The pitch-adjustment ring is rotatable to align the at least one permeable section with the high-pitched sound zone or the low-pitched sound zone.

In one or more embodiments, a speaker includes a frame, a pitch-adjustment ring and a toggle structure coupled to the pitch-adjustment ring. The frame has plural ribs interconnected to define a central through hole and at least one side through hole around the central through hole. The pitch-adjustment ring is rotatably coupled to the frame and covered over the at least one side through hole. The pitch-adjustment ring has at least one permeable section and at least one non-permeable section arranged alternately.

In one or more embodiments, the high-pitched sound zone has an electromagnetic component accommodating area and plural discontinuous sound chamber extension areas.

In one or more embodiments, the pitch-adjustment ring has a circular ring, and the at least one permeable section of the pitch-adjustment ring is configured to tunably shield the high-pitched sound.

In one or more embodiments, the frame comprises plural ribs interconnected to define a central through hole and at least one side through hole, the pitch-adjustment ring is configured to cover the at least one side through hole.

In one or more embodiments, the pitch-adjustment ring is rotatable within a slot formed between the plural ribs.

In one or more embodiments, the pitch-adjustment ring is rotatable within a cavity at a side of the frame.

In one or more embodiments, the speaker further includes a toggle structure coupled to the pitch-adjustment ring.

In one or more embodiments, the permeable section and the non-permeable section are alternately disposed on the pitch-adjustment ring.

In one or more embodiments, the permeable section includes plural pores in a sector or arc section.

In one or more embodiments, the central through hole is a circular hole, and the at least one side through hole is a sector-shaped hole.

In one or more embodiments, the toggle structure is inserted through the at least one side through hole and restricted by a boundary of the at least one side through hole.

In sum, the speaker disclosed herein utilizes its pitch-adjustment ring with permeable sections and non-permeable sections alternately arranged thereon and its toggle structure to rotate pitch-adjustment ring. The pitch-adjustment ring is rotatably coupled to the frame and the partition wall to adjust an output for the high-pitched sound zone and/or the low-pitched sound zone according to actual demands. The toggle structure is then designed in conjunction with the earphone housing to allow the user to tune the output for the high-pitched sound zone and/or the low-pitched sound zone conveniently.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
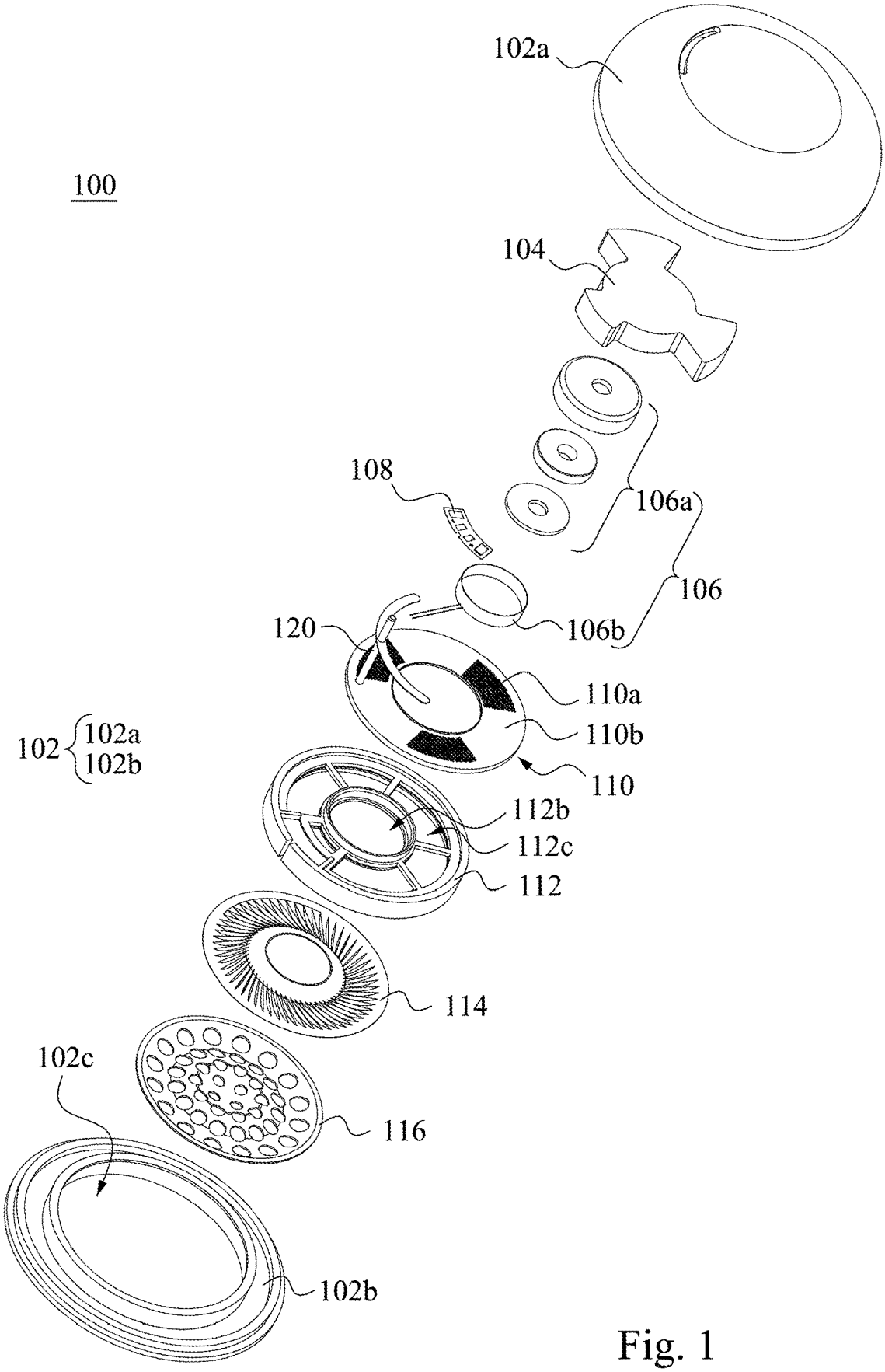
FIG. 1 illustrates an exploded view of a speaker according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

Reference is made to FIG. 1, which illustrates an exploded view of a speaker according to one embodiment of the present disclosure. A speaker 100 includes a partition wall 104, a frame 112, a diaphragm 114, a front cover 116, an electromagnetic component 106 and a housing 102, etc.

The electromagnetic component 106 includes a voice coil 106*b* and a magnetic part assembly 106*a* consisting of several components. The voice coil 106*b* is electrically connected to a driver circuit board 108 and is used to drive a diaphragm 114 vibrating to produce sound.

When all parts of the speaker are assembled, an outer rear cover 102*a* and a headset cover 102*b* are assembled to form the housing 102, which wraps the remaining components inside thereof. The front cover 116 is secured to a central opening 102*c* of the headset cover 102*b* and has plural sound output holes 116*a*.

Figure 2:
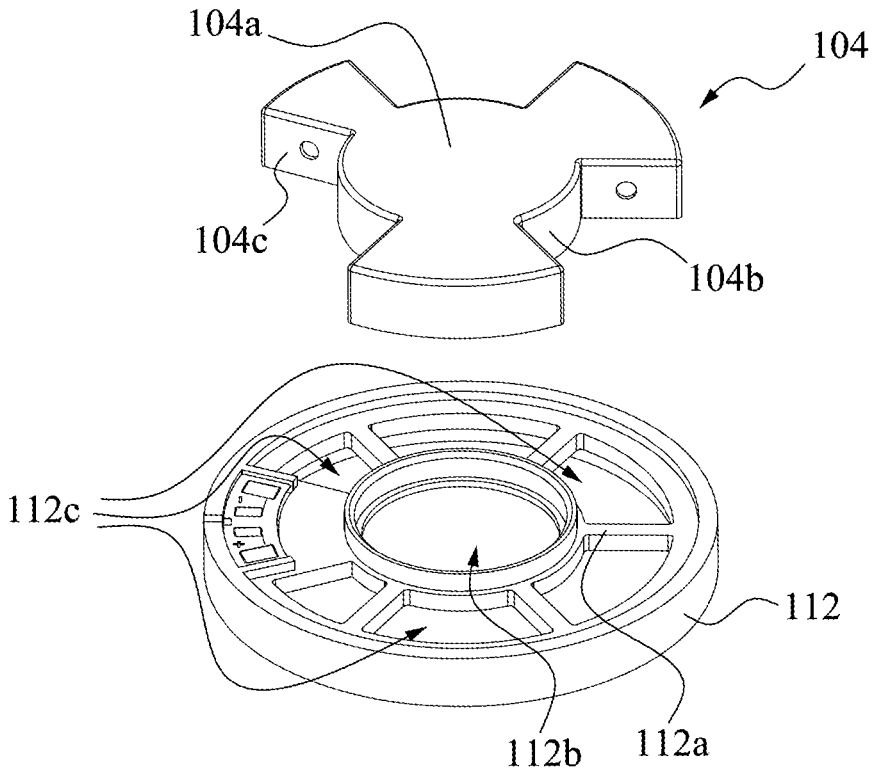
FIG. 2 illustrates a perspective view of some components of a speaker according to one embodiment of the present disclosure.

Reference is made to FIG. 2, which illustrates partition wall 104 and a frame 112 of a speaker. The partition wall 104 is secured to the frame 112 to serve as a sound wave boundary between a high-pitched sound zone and a low-pitched sound zone, e.g., forming a boundary to isolate sound waves in the high-pitched sound zone from sound waves in the low-pitched sound zone.

The partition wall 104 basically consists of a top wall 104*a* and plural sidewalls. The plural sidewalls include flat sidewalls 104*c* and arc-shaped sidewalls 104*b*.

The frame 112 includes plural ribs 112*a* to define a central through hole 112*b* and plural side through holes 112*c*. When the partition wall 104 and the frame 112 are assembled, the partition wall 104 covers the central through hole 112*b* and part of the side through holes 112*c* of the frame 112. In this embodiment, the central through hole 112*b* is a circular hole, and the side through holes 112*c* are sector-shaped or arc-shaped holes, but not being limited to.

Figure 3:
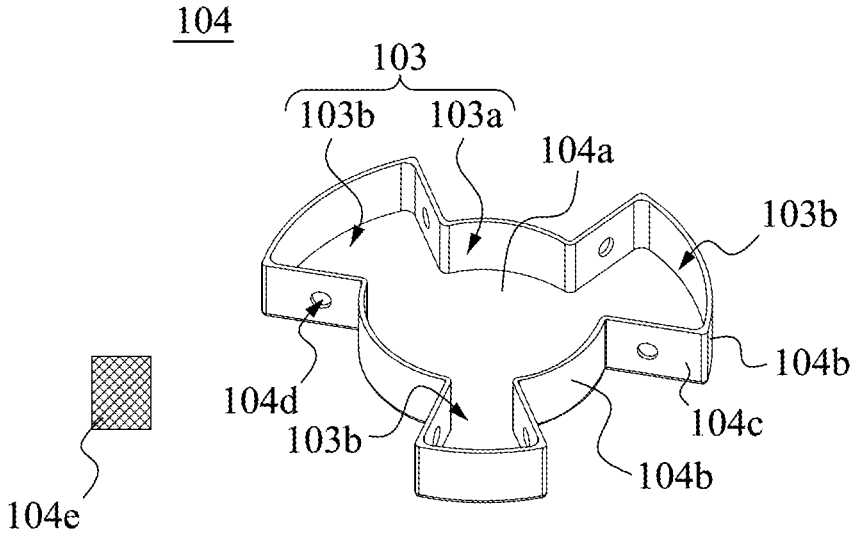
FIG. 3 illustrates a perspective view of a partition wall of the speaker as illustrated in FIG. 2.

Reference is made to FIG. 3, illustrates a perspective view of a partition wall 104 of the speaker in FIG. 2 from another view point. The high-pitched sound zone 103 wrapped around by the partition wall 104 includes an electromagnetic component accommodating area 103*a* and plural discontinuous sound chamber extension areas 103*b*. The electromagnetic component accommodating area 103*a* is configured to accommodate the electromagnetic component 106, and named after this function.

In this embodiment, the high-pitched sound zone 103 wrapped around by the partition wall 104 includes three discontinuous sound chamber extension areas 103*b*, and the electromagnetic component accommodating area 103*a* is a circular area while the plural discontinuous sound chamber extension areas 103*b* are discontinuous sector or arc area, but not being limited to.

The electromagnetic component accommodating area 103*a* and the plural discontinuous sound chamber extension areas 103*b* of the high-pitched sound zone 103 are fluid-communicable, e.g., fluid may be flown from one sound chamber extension area 103*b* to another sound chamber extension area 103*b* via the electromagnetic component accommodating area 103*a*.

Figure 4:
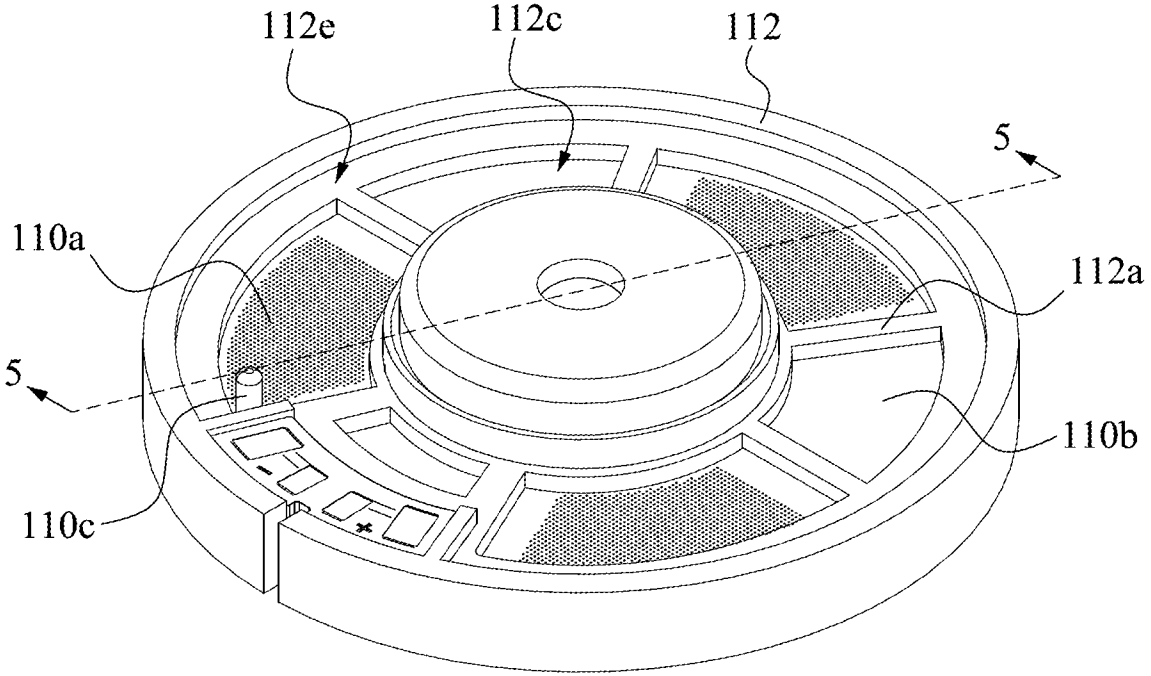
FIG. 4 illustrates a perspective view of a sound-producing unit within a speaker according to one embodiment of the present disclosure.

Reference is made to FIGS. 1-4. FIG. 4 illustrates a perspective view of a sound-producing unit (with its housing removed) according to one embodiment of the present disclosure. When all parts of the speaker are assembled, the electromagnetic component accommodating area 103*a* of the high-pitched sound zone 103 is configured to cover the central through hole 112*b* of the frame 112, and the plural discontinuous sound chamber extension areas 103*b* of the high-pitched sound zone 103 are configured to cover part of the side through holes 112*c*.

A pitch-adjustment sheet 110 has plural permeable sections 110*a* and plural non-permeable sections 110*b* arranged alternately thereon. The permeable section is also referred as a fluid-permeable section, e.g., gas or liquid permeable section. The pitch-adjustment sheet 110 is a circular ring which is rotatable on the frame 112, such that the permeable sections 110*a* of the pitch-adjustment sheet 110 is rotatable to tunably shield the high-pitched sound zone 103 in order to achieve the pitch-adjustable functionality.

In this embodiment, each permeable section 110*a* includes plural pores within a sector or arc section, but not being limited to. For example, each permeable section may plural pores within a non-sector or non-arc section.

In this embodiment, the pitch-adjustment sheet 110 may be a close-loop circular ring, but not being limited to. For example, the pitch-adjustment sheet may be an open-loop or non-circular ring.

In this embodiment, the sidewalls (104*b*, 104*c*) of the sound chamber extension area 103*b* have at least one vent hole 104*d*, and have a flow-regulation member 104*e* attached over the at least one vent hole 104*d*, e.g., the flow-regulation member 104*e* is attached to the sidewall to cover the vent hole 104*d*. The flow-regulation member 104*e* is a porous ventilating member, which distributes airflow evenly between the high-pitched sound zone and low-pitched sound zone to maintain the air pressure consistently.

Figure 5:
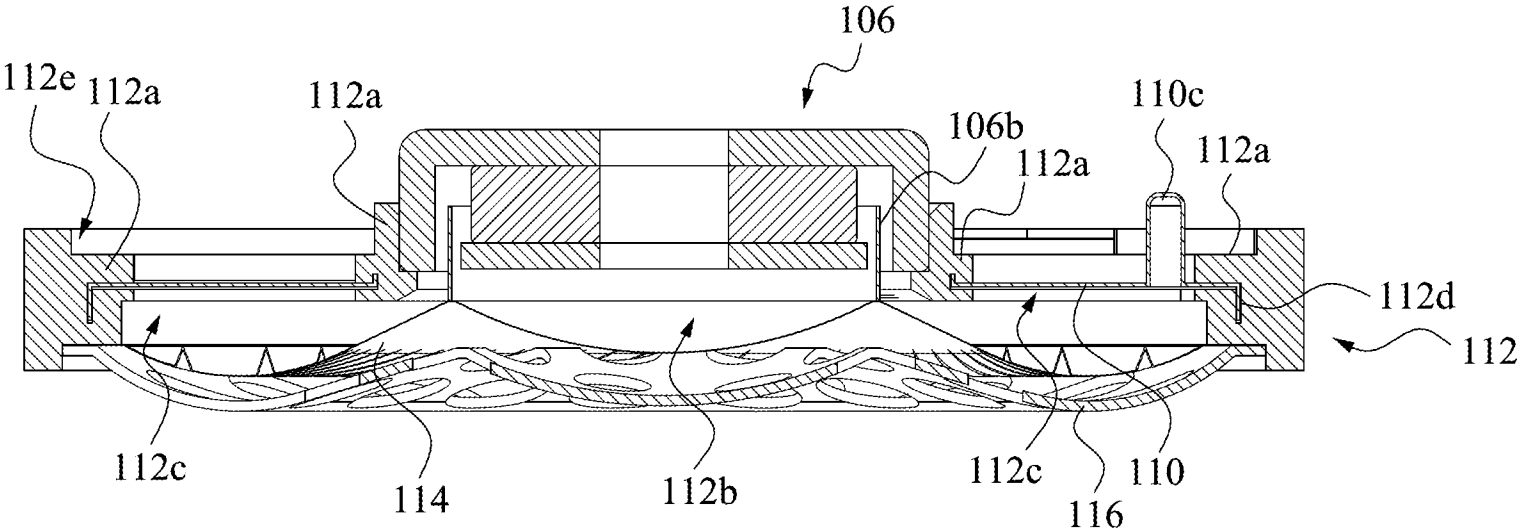
FIG. 5 illustrates a cross-sectional view of the sound-producing unit taken along the line 5-5 in FIG. 4.

Reference is made to FIGS. 4 and 5. FIG. 5 illustrates a cross-sectional view of the sound-producing unit taken along the line 5-5 in FIG. 4. In this embodiment, the pitch-adjustment sheet 110 may be rotatable within a slot 112*d* formed between the plural ribs 112*a*, but not being limited to. For example, the pitch-adjustment sheet 110 may be rotatable within a cavity 112*e* at a side of the frame 112, i.e. located between the plural ribs 112*a* and the partition wall 104.

The pitch-adjustment sheet 110 may have a toggle pin 110*c* which protrudes above the frame 112 such that a user to apply a force thereon to rotate the pitch-adjustment sheet 110 relative to the frame 112. In this embodiment, the toggle pin 110*c* may be inserted through a side through hole 112*c* of the frame 112, and restricted by a boundary of the side through hole 112*c*. Therefore, the user may conveniently adjust the toggle pin 110*c* to align the permeable sections 110*a* of the pitch-adjustment sheet 110 with the high-pitched sound zone or the low-pitched sound zone.

Figure 6A:
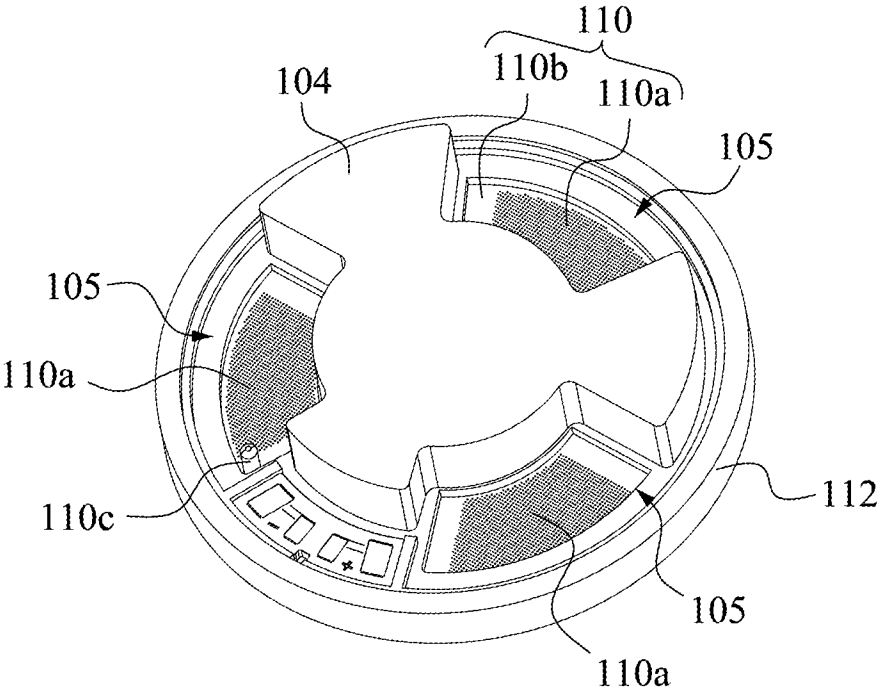
FIGS. 6A-6C illustrate three application status of a speaker according to one embodiment of the present disclosure.
Figure 6B:
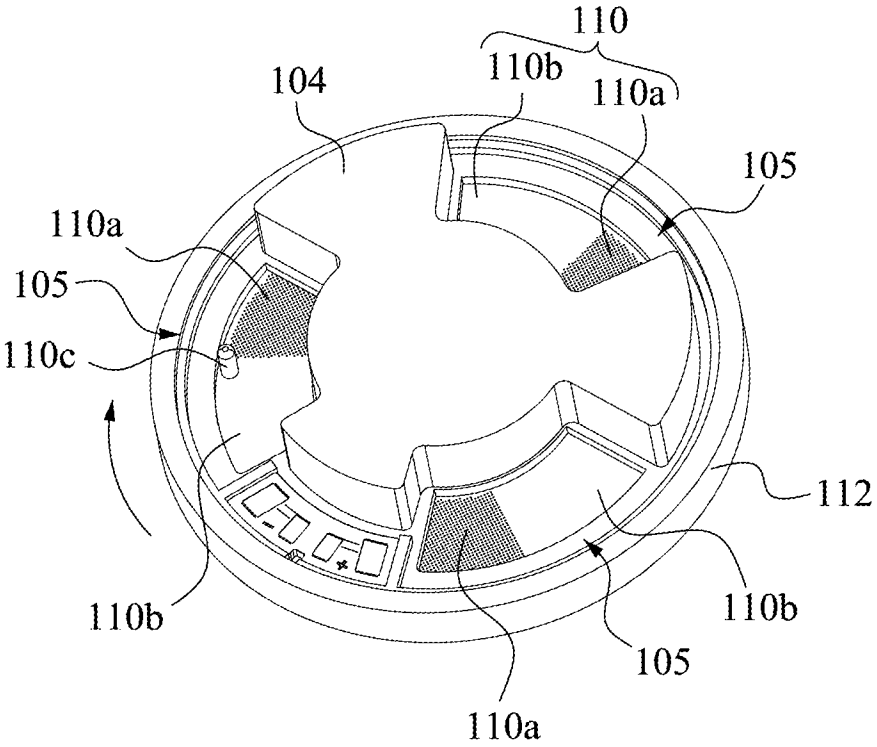
Figure 6C:
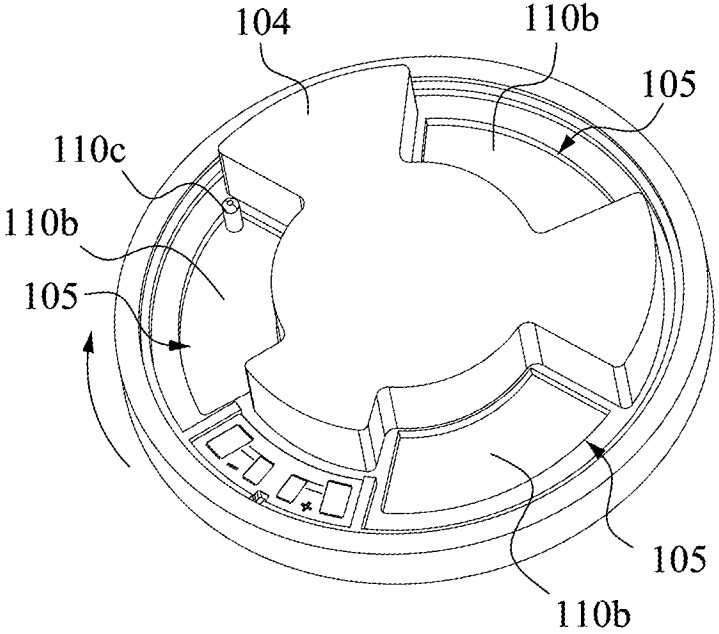

Reference is made to FIGS. 6A-6C. FIGS. 6A-6C illustrate three application status of a speaker respectively according to one embodiment of the present disclosure. The partition wall 104 forms a boundary between the high-pitched sound zone 103 and the low-pitched sound zone 105. The high-pitched sound zone 103 is a zone wrapped by the partition wall 104 (referring to FIG. 3) while the low-pitched sound zone 105 is a zone between the partition wall 104 and the housing of the speaker (i.e., including the outer rear cover 102*a* and the headset cover 102*b*).

Reference is made to FIG. 4 and FIG. 6A, the pitch-adjustment sheet 110 is positioned to have its permeable section 110*a* entirely located within the side through holes that belong to the low-pitched sound zone 105. Therefore, the side through holes that belong to the high-pitched sound zone 103 are entirely shielded by the non-permeable section 110*b*. The low-pitched sound output is greater than the high-pitched sound output in the application status of FIG. 6A.

From FIG. 6A to FIG. 6B, the pitch-adjustment sheet 110 is rotated clockwise by moving its toggle pin 110*c* to have more area of its permeable sections 110*a* located within the side through holes that belong to the low-pitched sound zone 105 and less area of its permeable sections 110*a* located within the side through holes that belong to the high-pitched sound zone 103. Therefore, part of the side through holes that belong to the high-pitched sound zone 103 are still shielded by the non-permeable section 110*b* (referring also to FIG. 4). The low-pitched sound output is still greater than the high-pitched sound output in the application status of FIG. 6B.

From FIG. 6B to FIG. 6C, the pitch-adjustment sheet 110 is further rotated clockwise by moving its toggle pin 110*c* to have its permeable sections 110*a* entirely located within the side through holes that belong to the high-pitched sound zone 103 (the permeable section 110*a* is entirely under the partition wall 104 and thus not illustrated in FIG. 6C). Therefore, the side through holes that belong to the low-pitched sound zone 105 are entirely shielded by the non-permeable section 110*b*. The high-pitched sound output is greater than the low-pitched sound output in the application status of FIG. 6C.

Figure 7:
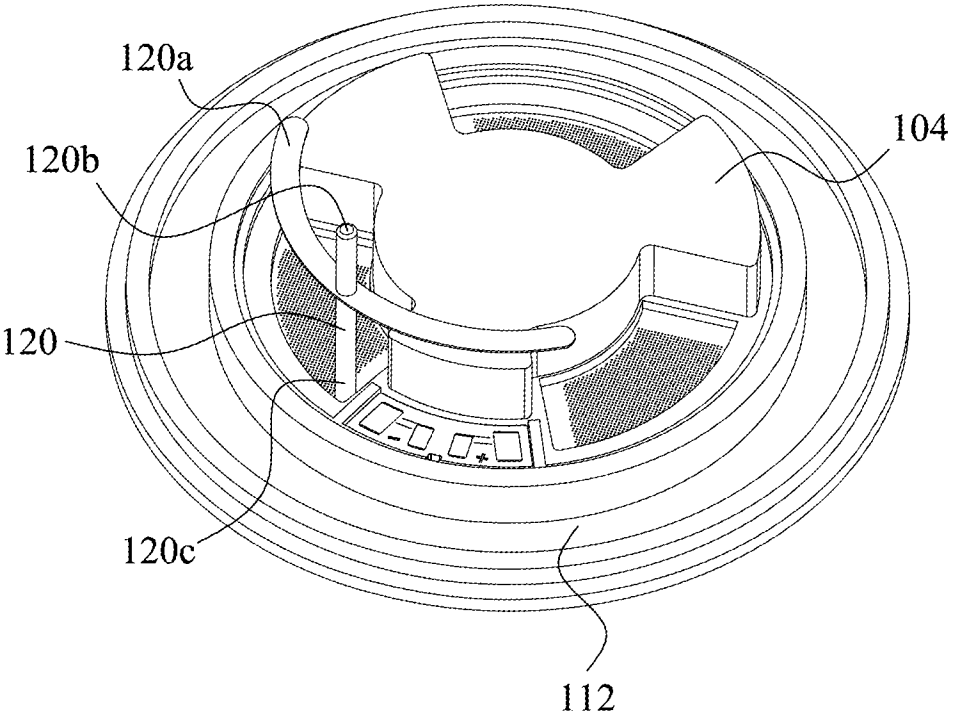
FIG. 7 illustrates a perspective view of a speaker equipped with a pitch-adjustable functionality according to an embodiment of the present disclosure (with an housing removed)
Figure 8:
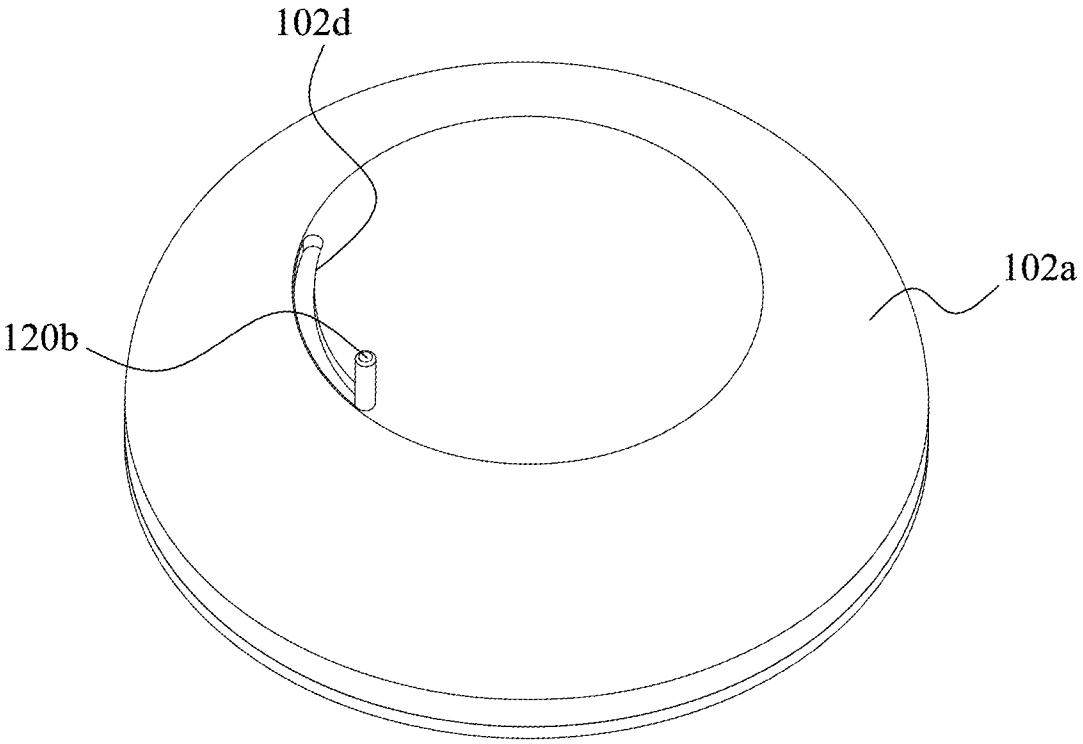
FIG. 8 illustrates an assembled view of a speaker equipped with a pitch-adjustable functionality according to an embodiment of the present disclosure.

Reference is made to FIGS. 7 and 8. FIGS. 7 and 8 respectively illustrate perspective views of a speaker equipped with a pitch-adjustable functionality according to an embodiment of the present disclosure (with or without a housing removed). A toggle structure 120 has its bottom portion 120*c* coupled with the toggle pin 110*c* of the pitch-adjustment sheet 110 (referring also to FIG. 6A), and has its top portion 120*b* protruding out through a slide cutout 102*d* of the outer rear cover 102*a* such that the user may drive the top portion 120*b* of the toggle structure 120 to rotate the pitch-adjustment sheet 110. The toggle structure 120 further includes a shielding piece 120*a* to seal the slide cutout 102*d* of the outer rear cover 102*a* to prevent external objects or moisture from entering the speaker. It should be noted that the toggle structure is not limited to the above structure or design, and any structure that can be connected to the pitch-adjustment sheet and protrudes out of the outer rear cover may be applicable, for example, a knob that can be connected to the pitch-adjustment sheet and protrudes out of the outer rear cover.

In sum, the speaker disclosed herein utilizes its pitch-adjustment sheet with permeable sections and non-permeable sections alternately arranged thereon and its toggle structure to rotate pitch-adjustment sheet. The pitch-adjustment sheet is rotatably coupled to the frame and the partition wall to adjust an output for the high-pitched sound zone and/or the low-pitched sound zone according to actual demands. The toggle structure is then designed in conjunction with the earphone housing to allow the user to tune the output for the high-pitched sound zone and/or the low-pitched sound zone conveniently.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A speaker comprising:

a frame having a central through hole and side through holes around the central through hole;

a partition wall coupled with the frame to form a boundary between a high-pitched sound zone and a low-pitched sound zone;

a diaphragm coupled with the frame;

a pitch-adjustment sheet disposed between the partition wall and the diaphragm, and rotatably coupled to the frame, the pitch-adjustment sheet has at least one permeable section and at least one non-permeable section, the pitch-adjustment sheet is rotatable to align the at least one permeable section with the high-pitched sound zone or the low-pitched sound zone; and a toggle structure coupled to the pitch-adjustment sheet, wherein the toggle structure is inserted through a corresponding one of the side through holes, and restricted by a boundary of the corresponding one of the side through holes.

2. The speaker of claim 1, wherein the high-pitched sound zone comprises an electromagnetic component accommodating area and plural discontinuous sound chamber extension areas.

3. The speaker of claim 1, wherein the pitch-adjustment sheet comprises a circular ring, and the at least one permeable section of the pitch-adjustment sheet is configured to tunably shield the high-pitched sound zone.

4. The speaker of claim 1, wherein the pitch-adjustment sheet is rotatable within a slot formed between the plural ribs.

5. The speaker of claim 1, wherein the pitch-adjustment sheet is rotatable within a cavity at a side of the frame.

6. The speaker of claim 1, wherein the permeable section and the non-permeable section are alternately disposed on the pitch-adjustment sheet.

7. The speaker of claim 1, wherein the permeable section comprises plural pores in a sector or arc section.

8. A speaker comprising:

a frame having plural ribs interconnected to define a central through hole and side through holes around the central through hole;

a plurality of discontinuous sound chamber extension areas of a high-pitched sound zone are configured to cover part of the side through holes;

a pitch-adjustment sheet rotatably coupled to the frame and covered over the side through holes, the pitch-adjustment sheet has at least one permeable section and at least one non-permeable section arranged alternately; and a toggle structure coupled to the pitch-adjustment sheet, wherein the toggle structure is inserted through a corresponding one of the side through holes, and restricted by a boundary of the corresponding one of the side through holes.

9. The speaker of claim 8, wherein the central through hole is a circular hole, and each of the side through holes is a sector-shaped hole.

10. The speaker of claim 8, wherein the pitch-adjustment sheet comprises a circular ring, and the at least one permeable section of the pitch-adjustment sheet is configured to tunably shield the side through holes.

11. The speaker of claim 8, wherein the pitch-adjustment sheet is rotatable within a slot formed between the plural ribs.

12. The speaker of claim 8, wherein the pitch-adjustment sheet is rotatable within a cavity at a side of the frame.

* * * * *